US006324696B1

(12) United States Patent
Montgomery

(10) Patent No.: US 6,324,696 B1
(45) Date of Patent: Dec. 4, 2001

(54) SOUVENIR BASEBALL MITT

(76) Inventor: James G. Montgomery, 14611 Hollow Ash Ct., Houston, TX (US) 77015

( * ) Notice: Subject to any disclaimer, the term of this patent is extended or adjusted under 35 U.S.C. 154(b) by 1 days.

(21) Appl. No.: 09/634,987

(22) Filed: Aug. 8, 2000

(51) Int. Cl.[7] ..... A41D 13/08
(52) U.S. Cl. ..... 2/19; 2/158; 446/26
(58) Field of Search ..... 2/158.16, 20, 19, 2/161.1; 40/1, 586; 446/26, 327; 15/227

(56) References Cited

U.S. PATENT DOCUMENTS

D. 397,363 * 8/1998 Williams ..... D20/33
2,687,729 * 8/1954 Slavin ..... 15/227
4,088,127 * 5/1978 Clayton et al. ..... 128/24.1
4,457,640 * 7/1984 Anderson ..... 401/7
4,486,975 * 12/1984 Harreld et al. ..... 446/220
4,523,348 * 6/1985 Petrie ..... 15/227
4,829,600 * 5/1989 Courtney ..... 2/19
4,996,721 * 3/1991 Beshro ..... 2/19
5,433,025 * 7/1995 Borghese ..... 40/586
5,542,129 * 8/1996 Munoz ..... 2/209.12
5,881,384 * 3/1999 Williams ..... 2/158
6,108,817 * 8/2000 Kostelac ..... 2/159

* cited by examiner

*Primary Examiner*—John J. Calvert
*Assistant Examiner*—Katherine Moran
(74) *Attorney, Agent, or Firm*—Randal D. Homburg

(57) ABSTRACT

The invention is a souvenir baseball mitt made of laminated foam which is utilized to display team logo and also includes a cavity in the back portion of the mitt to accommodate a spectator's hand to catch a baseball in the event a baseball is hit or thrown in the direction of the spectator.

3 Claims, 3 Drawing Sheets

SOUVENIR BASEBALL MITT

CROSS REFERENCE TO RELATED APPLICATIONS

None

I. BACKGROUND OF THE INVENTION

1. Field of Invention

The invention is a souvenir baseball mitt made of laminated foam which is utilized to display team logo and also includes a cavity in the back portion of the mitt to accommodate a spectator's hand to catch a baseball in the event a baseball is hit or thrown in the direction of the spectator.

2. Description of Prior Art

The following United States patents are disclosed herein and incorporated into this application for utility patent. All relate to baseball mitts or items including hand protection. A method of fabricating a baseball glove from a single sheet of paperboard is disclosed in U.S. Pat. No. 4,532,653 to Riaboff, which discloses a multiple folding pattern to make a baseball mitt item from cardboard. A hand protector for baseball players, martial artists or other athletes involved in sports where the hands are used for contact sis disclosed in U.S. Pat. No. 5,781,928 to Avila.

Combination baseball hats with baseball mitts are disclosed in U.S. Pat. No. 5,920,913 to Brandon, et al. and U.S. Pat. No. 4,768,232 to Villalobos, incorporating a hand compartment in the hat and designed mainly to reduce the impact of a speeding baseball being caught or deflected.

II. SUMMARY OF THE INVENTION

The primary objective of the invention is to provide a souvenir baseball mitt which is simple in shape and is relatively flat so that such souvenir may be displayed when taken home. A Second objective of the invention is to include a hand cavity in the back of the souvenir to allow the souvenir to be placed on either hand of the user allowing it to be quickly placed on the hand of the user to catch a baseball hit or thrown in his direction using the souvenir to catch or deflect the baseball with greatly reduced impact, protecting the hand of the user. A third objective of the invention is to provide such souvenir in a material which is collapsible for carrying ease which will resume its intended shape for display.

III. DESCRIPTION OF THE DRAWINGS

The following drawings are submitted with this utility patent application.

Figure 2:
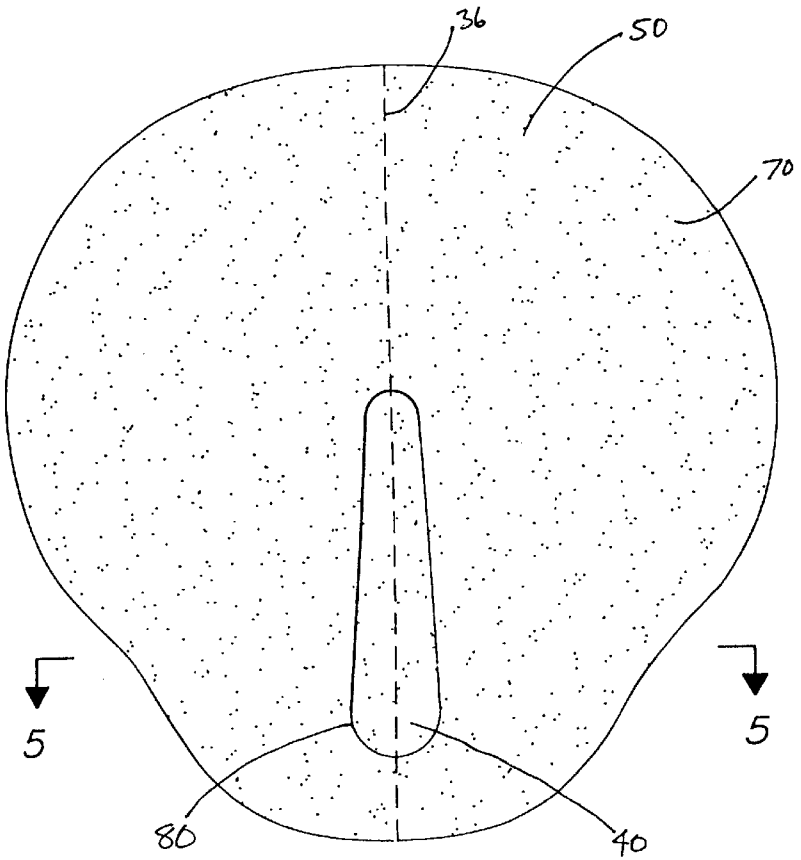
Figure 1:
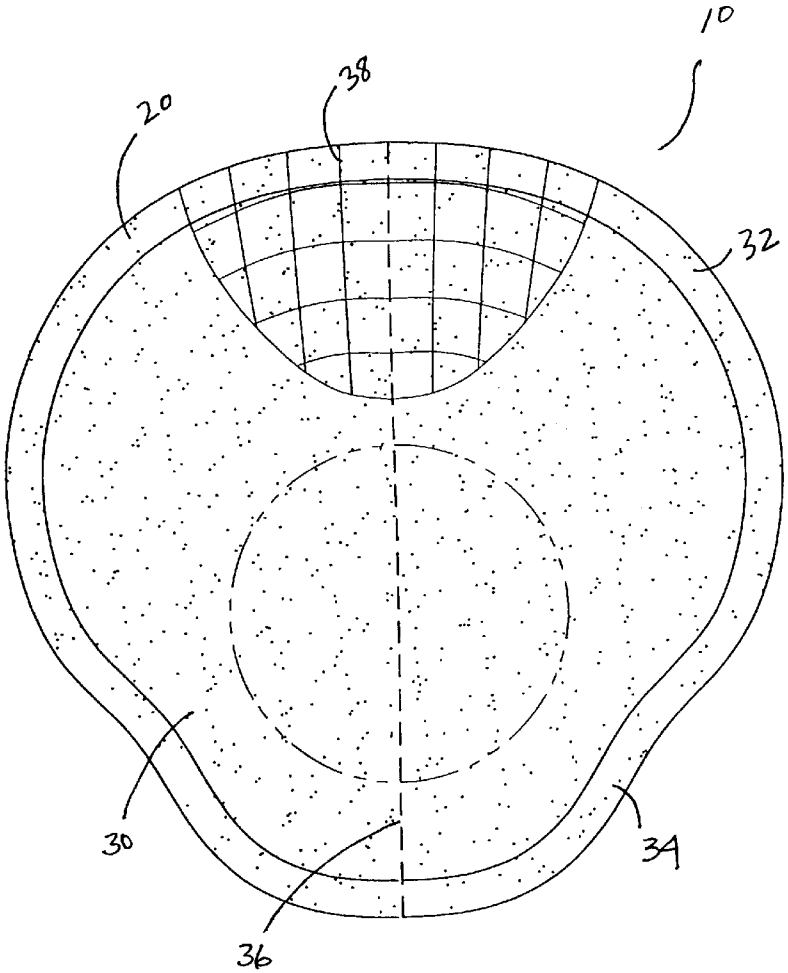
Figure 4:
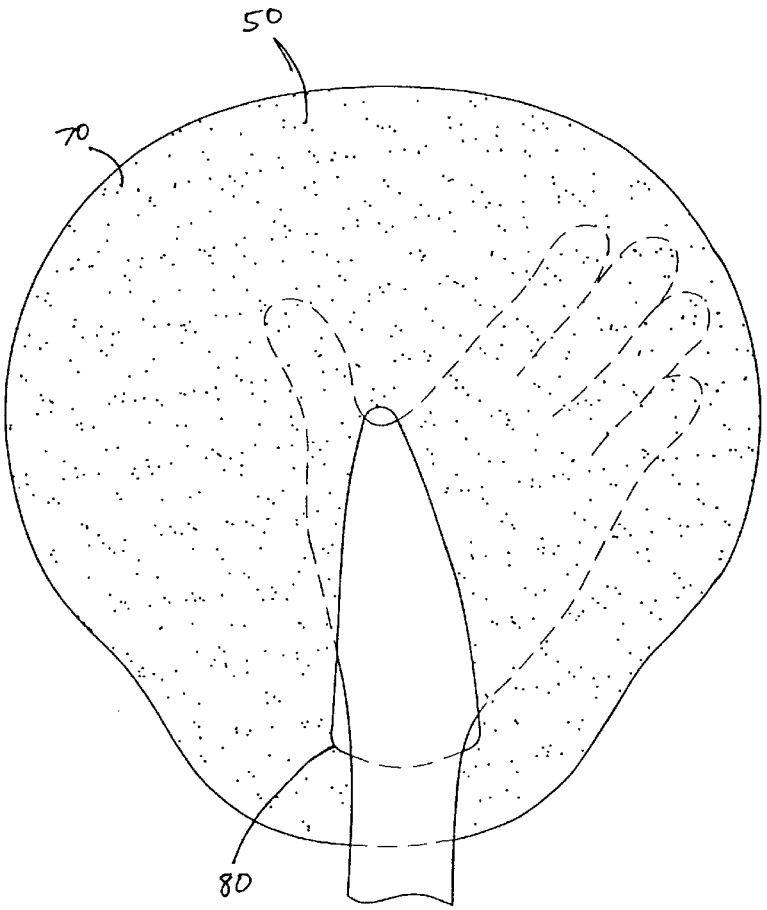
Figure 3:
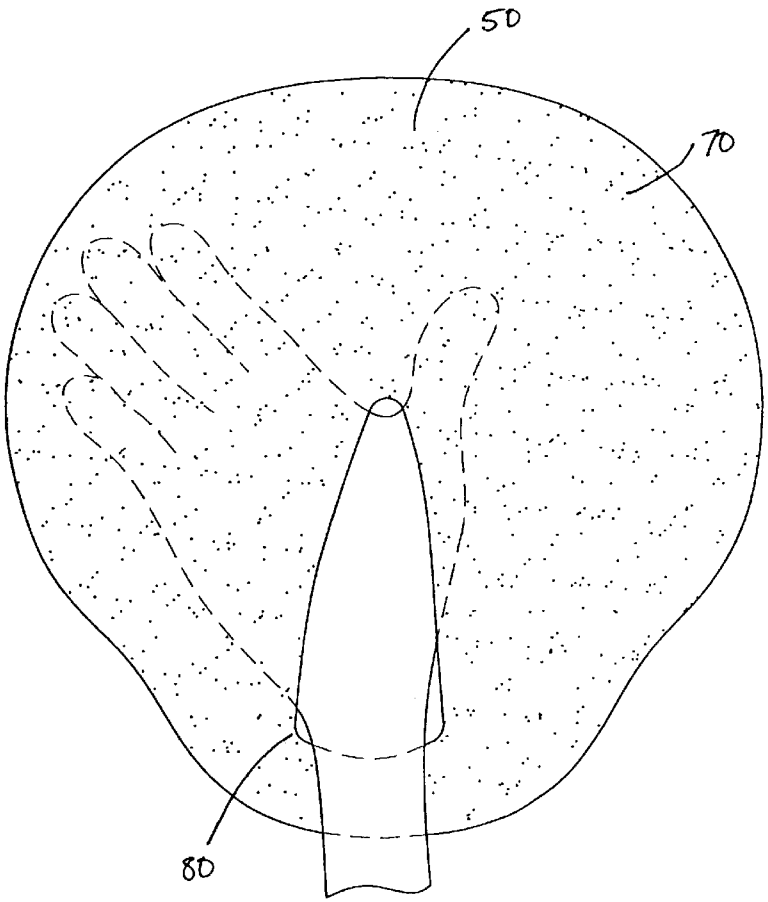
Figure 3:
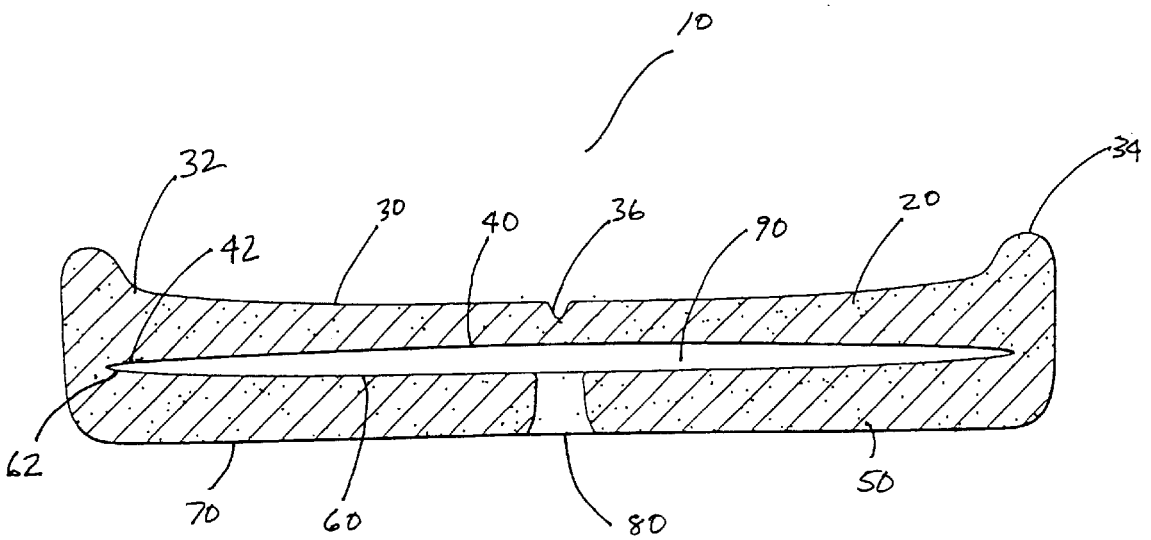

FIG. 1: front section of mitt,

FIG. 2: back section of mitt,

FIG. 3: back section w/wearer's hand inserted through slot,

FIG. 4: back section w/wearer's opposite hand inserted through slot,

FIG. 5: cross-section view of mitt.

IV. DESCRIPTION OF THE PREFERRED EMBODIMENT

The invention is a souvenir baseball mitt 10 intended for use by a baseball fan and spectator, the invention comprising a front section 20 and a back section 50 made of a collapsible foam material. The front section 20 includes an outside surface 30 having a linear folding crease 36 and an inside surface 40 having a perimeter edge 42, the front section 20 being provided in a general flat, circular shape. In a preferred embodiment, the outside surface 30 contains printed lines 38 giving the outside surface 30 the appearance of a baseball mitt and may be colored similar to the team colors and logo of the user's favorite baseball team. In another preferred embodiment, the outside surface 30 has a perimeter 32 which includes an elevated ridge 34 which provides an improvement in the user's ability to retain a baseball within the outside surface 30 when a ball is caught.

The back section 50 includes an inside surface 60 having a perimeter edge 62, an outside surface 70 and a linear slot 80 which penetrates from the outside surface 70 to the inside surface 60 of the back section 50, but not completely to the perimeter edge 62, the back section 50 being provided also in a general flat, circular shape identical to the front section 20.

The perimeter edge 42 of the inside surface 40 of the front section 20 is attached to the perimeter edge 62 of the inside surface 60 of the back section 50. A cavity 90 is formed between the inside surface 40 of the front section 20 and the inside surface 60 of the back section 50, which is suitable for the placement of a hand, either night or left. It is most preferred that the linear folding crease 36 in the outside surface 30 of the front section 20 be aligned with the linear slot 80 of the back section 50, placing the linear folding crease 36 in the approximate location of a natural fold 102 of the hand 100 of the person inserting his hand 100 within the cavity 90.

To use the invention 10, the user simply inserts his hand 100 through the linear slot 80 of the back section 50, places his hand 100 within the cavity 90 where the palm 104 of the user's hand 100 is against the inside surface 40 of the front section 20, and wears the invention 10 either in a manner to display the outside surface 30 of the front section 20 of the invention 10, or to actually use the invention 10 to catch or deflect a baseball hit or thrown in the direction of the user protecting the hand 100 of the user from the impact of the baseball.

While the invention has been particularly shown and described with reference to a preferred embodiment thereof, it will be understood by those skilled in the art that changes in form and detail may be made therein without departing from the spirit and scope of the invention.

What is claimed is:

1. A souvenir baseball mitt to be worn on a hand of a person comprising:

a. a generally flat circular front section having an outside surface with a folding crease and an inside surface having a perimeter edge;

b. a generally flat circular back section having an inside surface with a perimeter edge, an outside surface and a linear slot from the outside surface to the inside surface of said back section;

wherein the perimeter edge of the inside surface of the back section is attached to the perimeter edge of the inside surface of the front section providing a cavity between the inside surface of the front section and the inside surface of the back section to accommodate the hand of the person.

2. The invention as disclosed in claim 1, further comprising, the front section and the back section are made from collapsible foam material and the outside surface of the front section has printed lines on such surface giving the invention the appearance of a baseball mitt.

3. The invention as disclosed in claim 1, further comprising, the outside surface of the front section having a perimeter edge including an elevated ridge.

* * * * *